US009417551B2

(12) United States Patent
Toriyama

(10) Patent No.: US 9,417,551 B2
(45) Date of Patent: Aug. 16, 2016

(54) IMAGE FORMING APPARATUS FOR DENSITY EVENNESS IN A VERTICAL SCANNING DIRECTION

(71) Applicant: Konica Minolta, Inc., Tokyo (JP)

(72) Inventor: Hideyuki Toriyama, Aichi (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/624,123

(22) Filed: Feb. 17, 2015

(65) Prior Publication Data

US 2015/0234310 A1 Aug. 20, 2015

(30) Foreign Application Priority Data

Feb. 17, 2014 (JP) ..... 2014-027279

(51) Int. Cl.
*B41J 2/47* (2006.01)
*G03G 15/041* (2006.01)

(52) U.S. Cl.
CPC ..... *G03G 15/0415* (2013.01)

(58) Field of Classification Search
CPC ..... H04N 1/393; G03G 15/04036
USPC ..... 347/231, 234, 235, 243, 248–250, 347/259–261
See application file for complete search history.

(56) References Cited

U.S. PATENT DOCUMENTS 5,530,642 A * 6/1996 Lofthus ..... H04N 1/393 347/261
7,382,387 B2 6/2008 Ichikawa et al.
7,417,652 B2 8/2008 Yamazaki
8,094,177 B2 * 1/2012 Murayama ..... G03G 15/04036 347/235
2014/0301748 A1 * 10/2014 Suzuki ..... G03G 15/5025 399/49

FOREIGN PATENT DOCUMENTS

JP 2007-088564 A 4/2007
JP 2007-156192 A 6/2007
JP 2007-179005 A 7/2007
JP 2009-015256 A 1/2009

OTHER PUBLICATIONS

Office Action issued in corresponding Japanese Application no. 2014-027279, mailed Jan. 26, 2016 (7 pages).

* cited by examiner

*Primary Examiner* — Lam Nguyen
(74) *Attorney, Agent, or Firm* — Osha Liang LLP

(57) ABSTRACT

An image forming apparatus includes the following. An image forming unit forms an image. An image magnification changing unit changes a rotating speed of a polygon motor to change magnification of the image. A reference position detecting unit detects a reference position of a predetermined target component in a vertical scanning direction. A target component position calculating unit calculates a position of the target component based on a detecting result and a signal of a predetermined cycle according to the rotating speed of the polygon motor. A storage unit stores a correction table to correct density unevenness. An image data correcting unit obtains correction data based on the position of the target component and corrects the image data. A parameter correcting unit corrects a parameter according to a timing that the rotating speed of the polygon motor is changed.

5 Claims, 5 Drawing Sheets

IMAGE FORMING APPARATUS FOR DENSITY EVENNESS IN A VERTICAL SCANNING DIRECTION

BACKGROUND

1. Field of the Invention

The present invention relates to an image forming apparatus.

2. Description of Related Art

Conventionally, in an electro-photographic type image forming apparatus, when an image is formed on both the front face and the back face of the same sheet, since the toner image formed on the sheet is heated to be fixed, the sheet after forming the image on the front face shrinks about a few %. Therefore, when the image is formed on both faces of the sheet, the image on the back face needs to be formed considering the shrinkage of the sheet, or a problem such as the size of the image being different between the front face and the back face occurs. As one method to solve the above problem, there is a technique to control the magnification of the image by adjusting the rotating speed of the polygon motor for rotating the polygon mirror between the front face and the back face (see Japanese Patent Application Laid-Open Publication No. 2007-179005).

Moreover, in an electro-photographic type image forming apparatus, unevenness in density in the vertical scanning direction may occur depending on the rotating cycle of the photoreceptor drum, developer or the like. Usually, the image processing is performed in a line cycle. Therefore, according to a simple configuration using a counter to count up in the line cycle, the position of the photoreceptor drum, etc. in the vertical scanning direction is calculated and the density unevenness in the vertical scanning direction is corrected based on the calculated position (Japanese Patent Application Laid-Open Publication No. 2007-156192).

However, if the rotating speed of the polygon motor is changed to adjust the magnification between the front face and the back face, the line cycle changes. With this, the interval of the photoreceptor drum, etc. in the vertical scanning direction which corresponds to the line cycle changes. This causes the problem that the calculated position of the photoreceptor drum, etc. in the vertical scanning direction becomes different in the amount that the magnification is adjusted if the line cycle is merely counted up. Therefore, according to the conventional technique, when the magnification is changed, the space between the sheets needed to be sufficiently opened by, for example, waiting for the position of the photoreceptor drum, etc. to come to its reference position in the vertical scanning direction and resetting the counter, etc. Consequently, high speed processing is not possible.

SUMMARY

The present invention has been made in consideration of the above problems, and one of the main objects is, in a case where density unevenness in a vertical scanning direction caused by a target component is corrected, to accurately calculate a position of the target component even when a cycle of a signal to calculate the position of the target component in the vertical scanning direction is changed.

In order to achieve at least one of the above-described objects, according to an aspect of the present invention, there is provided an image forming apparatus including:

an image forming unit which scans a laser light based on image data with a polygon mirror to expose light to a photoreceptor drum to form an electrostatic latent image on the photoreceptor drum and forms an image by attaching toner to the electrostatic latent image;

an image magnification changing unit which changes a rotating speed of a polygon motor for rotating the polygon mirror to change magnification of the image;

a reference position detecting unit which detects a reference position of a predetermined target component in a vertical scanning direction, the predetermined target component causing density unevenness in the vertical scanning direction;

a target component position calculating unit which calculates a position of the target component in the vertical scanning direction based on a detecting result of the reference position of the target component in the vertical scanning direction by the reference position detecting unit and a signal of a predetermined cycle according to the rotating speed of the polygon motor;

a storage unit which stores a correction table in which a position of the target component in the vertical scanning direction is corresponded to correction data to correct density unevenness caused by the target component;

an image data correcting unit which obtains the correction data corresponded to the position of the target component in the vertical scanning direction from the correction table based on the position of the target component in the vertical scanning direction calculated by the target component position calculating unit and corrects the image data based on the obtained correction data; and a parameter correcting unit which corrects a parameter in the target component position calculating unit according to a timing that the rotating speed of the polygon motor is changed by the image magnification changing unit.

Preferably, in the image forming apparatus, the target component position calculating unit includes a counter which is reset when the reference position of the target component in the vertical scanning direction is detected by the reference position detecting unit and adds a predetermined adding value each time based on the signal; and the target component position calculating unit calculates the position of the target component in the vertical scanning direction based on a ratio of a counting value of the counter to a one rotation counting value corresponding to one rotation of the target component.

Preferably, in the image forming apparatus, the signal is a signal showing a cycle of each line; and the counter adds the adding value at each cycle of each line.

Preferably, in the image forming apparatus, the adding value is a same value between before and after correction by the parameter correcting unit; and the parameter correcting unit corrects the counting value of the counter and the one rotation counting value in the target component position calculating unit depending on the magnification according to the timing that the rotating speed of the polygon motor is changed by the image magnification changing unit.

Preferably, in the image forming apparatus, the one rotation counting value is a same value between before and after correction by the parameter correcting unit; and the parameter correcting unit corrects the adding value in the target component position calculating unit depending on the magnification according to the timing that the rotating speed of the polygon motor is changed by the image magnification changing unit.

Preferably, in the image forming apparatus, the image magnification changing unit changes the magnification of the image according to whether the image is formed on a front face or a back face of a sheet.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

First Embodiment

First, the first embodiment of an image forming apparatus of the present invention is described. The image forming apparatus of the present invention is applied in an electrophotographic type copier, and the like.

Figure 1:
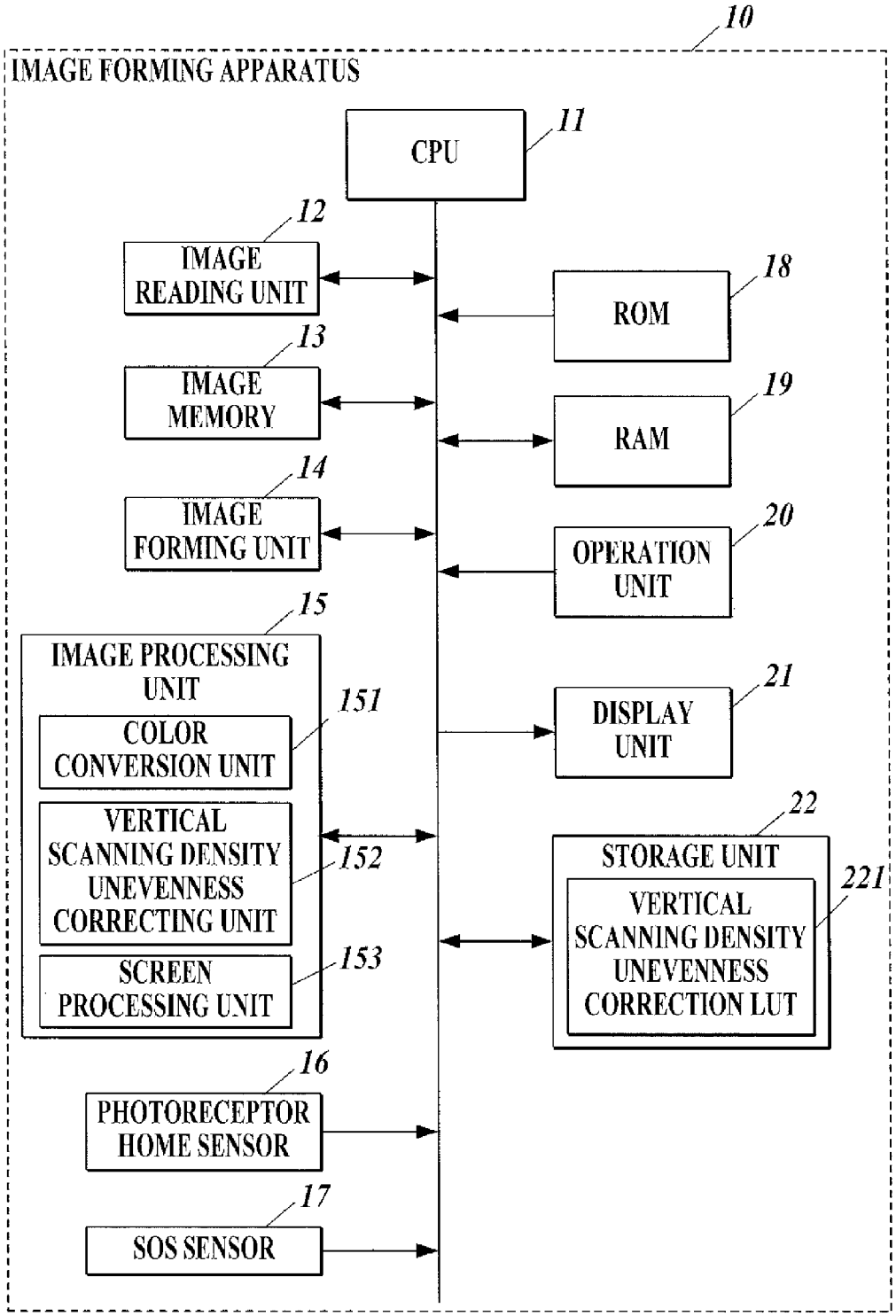
FIG. 1 is a block diagram showing a functional configuration of an image forming apparatus of the first embodiment.

FIG. 1 is a block diagram showing a functional configuration of an image forming apparatus 10 of the first embodiment.

As shown in FIG. 1, the image forming apparatus 10 includes a CPU (Central Processing Unit) 11, an image reading unit 12, an image memory 13, an image forming unit 14, an image processing unit 15, a photoreceptor home sensor 16, a SOS (Start of Scan) sensor 17, a ROM (Read Only Memory) 18, a RAM (Random Access Memory) 19, an operation unit 20, a display unit 21, a storage unit 22, and the like.

The CPU 11 reads various processing programs stored in the ROM 18 and expands the programs in the RAM 19. According to the expanded programs, the CPU 11 controls each unit of the image forming apparatus 10.

The image reading unit 12 includes a light source, a CCD (Charge Coupled Device) image sensor, an A/D convertor, etc. The image reading unit 12 reads an image of a document by imaging a reflecting light of light illuminated and scanned on a document from a light source and photoelectric conversion of the image. After A/D conversion of the read image, the obtained image data of R (red), G (green), and B (blue) is output to the CPU 11.

The image memory 13 stores the image data obtained by the image reading unit 12.

The CPU 11 synchronizes with the timing that the sheet is conveyed, and transmits image data (RGB data) from the image memory 13 to the image processing unit 15.

The image forming unit 14 performs image forming in an electro-photographic format. The image forming unit 14 includes a photoreceptor drum 141 (see FIG. 2), a charging unit which charges the photoreceptor drum 141, an exposing unit which exposes and scans the surface of the photoreceptor drum 141 based on the image data and forms an electrostatic latent image (light source 142, polygon mirror 143, etc. of FIG. 2), a developing unit which attaches toner to the electrostatic latent image on the photoreceptor drum 141, a transfer unit which transfers a toner image formed on the photoreceptor drum 141 onto a sheet, a fixing unit which fixes the toner image formed on the sheet, and the like.

Figure 2:
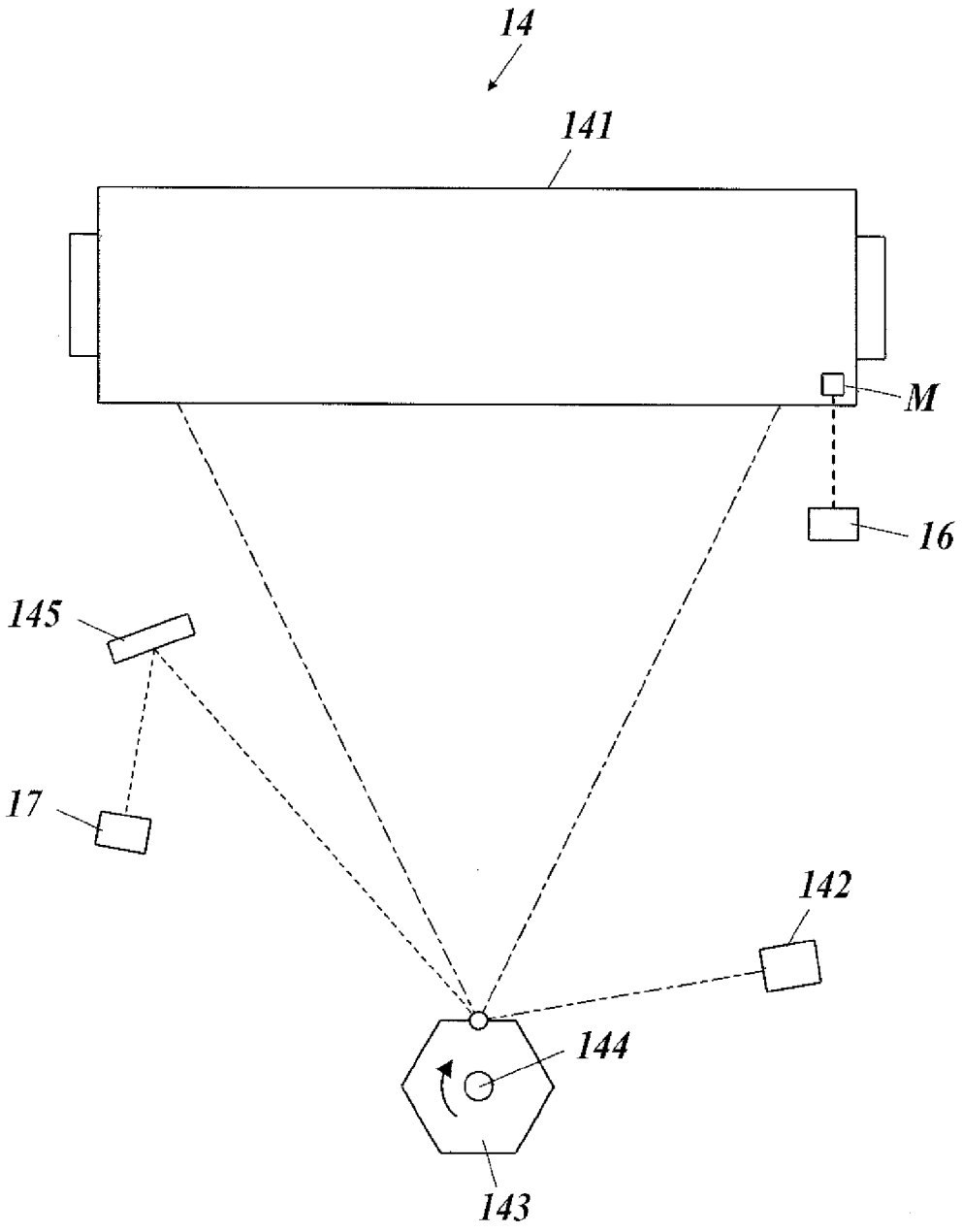
FIG. 2 is a schematic diagram of a configuration of a photoreceptor drum and exposing unit of an image forming unit.

FIG. 2 shows a schematic configuration of the photoreceptor drum 141 and the exposing unit of the image forming unit 14.

The image forming unit 14 includes, a photoreceptor drum 141, a light source 142, a polygon mirror 143, a polygon motor 144, a mirror 145, etc. In the present embodiment, the photoreceptor drum 141 is provided as an example of a predetermined target component which causes density unevenness in the vertical scanning direction and the mechanism of calculating the position of the photoreceptor drum 141 is described.

The photoreceptor drum 141 rotates in a certain predetermined cycle, and causes density unevenness in the vertical scanning direction due to characteristics of the photoreceptor drum 141.

The light source 142 is a semiconductor laser which emits laser light based on the image data.

The polygon mirror 143 is a polygonal columnar shape in which the side face is a mirror, and reflects laser light emitted from the light source 142. The polygon mirror 143 rotates around a rotating axis so that the laser light reflected on the mirror scans from one edge of the photoreceptor drum 141 to the other edge and exposes light to the photoreceptor drum 141.

The polygon motor 144 is a motor to rotate the polygon mirror 143. The rotating speed of the polygon mirror 144 can be changed with the control by the CPU 11.

The mirror 145 reflects the laser light reflected from the polygon mirror 143 and guides the light to the SOS sensor 17.

The image processing unit 15 performs image processing on the image data read and obtained by the image reading unit 12 and outputs the result to the image forming unit 14. The image processing unit 15 is realized with software processing by the CPU 11 in coordination with a program stored in the ROM 18. The image processing unit 15 includes a color conversion unit 151 which performs color conversion processing on the image data, a vertical scanning density unevenness correcting unit 152 which performs vertical scanning density unevenness correction processing on the image data based on the correction data to erase density unevenness in the vertical scanning direction, a screen processing unit 153 which performs screen processing to change the image to dots based on the number of screen lines pre-set in the image data, and the like.

The image processing unit 15 is composed of a PLD (Programmable Logic Device) such as a FPGA (Field Programmable Gate Array), etc., or an integrated circuit such as an ASIC (Application Specific Integrated Circuit) or a combination of the above, and can perform image processing according to the function included in the circuit.

The photoreceptor home sensor 16 is a reference position detecting unit which detects a preset reference position in any position in the vertical scanning direction (circumference direction) of the photoreceptor drum 141. For example, as shown in FIG. 2, a marker M showing the reference position is provided on the photoreceptor drum 141 in any position in the vertical scanning direction. The photoreceptor home sensor 16 outputs to the CPU 11 a home sensor signal showing the reference position of the photoreceptor drum 141 in the vertical scanning direction.

The SOS sensor 17 detects the laser light reflected by the mirror 145, and outputs the SOS signal (horizontal scanning exposure start reference signal) to the CPU 11. In other words, the SOS sensor 17 detects the timing of writing the line exposed by one edge of the side face (mirror) of the polygon mirror 143.

The ROM 18 includes a nonvolatile semiconductor memory, etc. and stores various processing programs and data and files necessary to perform the programs.

The RAM 19 forms a work area to temporarily store the various processing programs read from the ROM 18, input or output data, and the like when the CPU 11 performs the various processing.

The operation unit 20 includes a touch panel formed so as to cover the display screen of the display unit 21, and various operation buttons such as a numeric button, start button and the like. The operation unit 20 outputs the operation signal according to the operation by the user to the CPU 11.

The display unit 21 includes an LCD (Liquid Crystal Display), and displays various operation buttons, status of the apparatus, operation status of each function, and the like on the display screen according to an instruction of the display signal input from the CPU 11.

The storage unit 22 includes a hard disk, a flash memory, etc., and stores various types of data. Specifically, a vertical scanning density unevenness correction LUT (Look Up Table) 221 is stored in the storage unit 22. The vertical scanning density unevenness correction LUT 221 is a correction table associating a position of the photoreceptor drum 141 in the vertical scanning direction (reference address) and the correction data to correct the density unevenness caused by the photoreceptor drum 141. When the address of the vertical scanning density unevenness correction LUT 221 (position of the photoreceptor drum 141 in the vertical scanning direction) is B bits, one rotation of the photoreceptor drum 141 is divided into 256 segments, and correction data to correct the density unevenness in the vertical scanning direction is stored for each segment.

Figure 3:
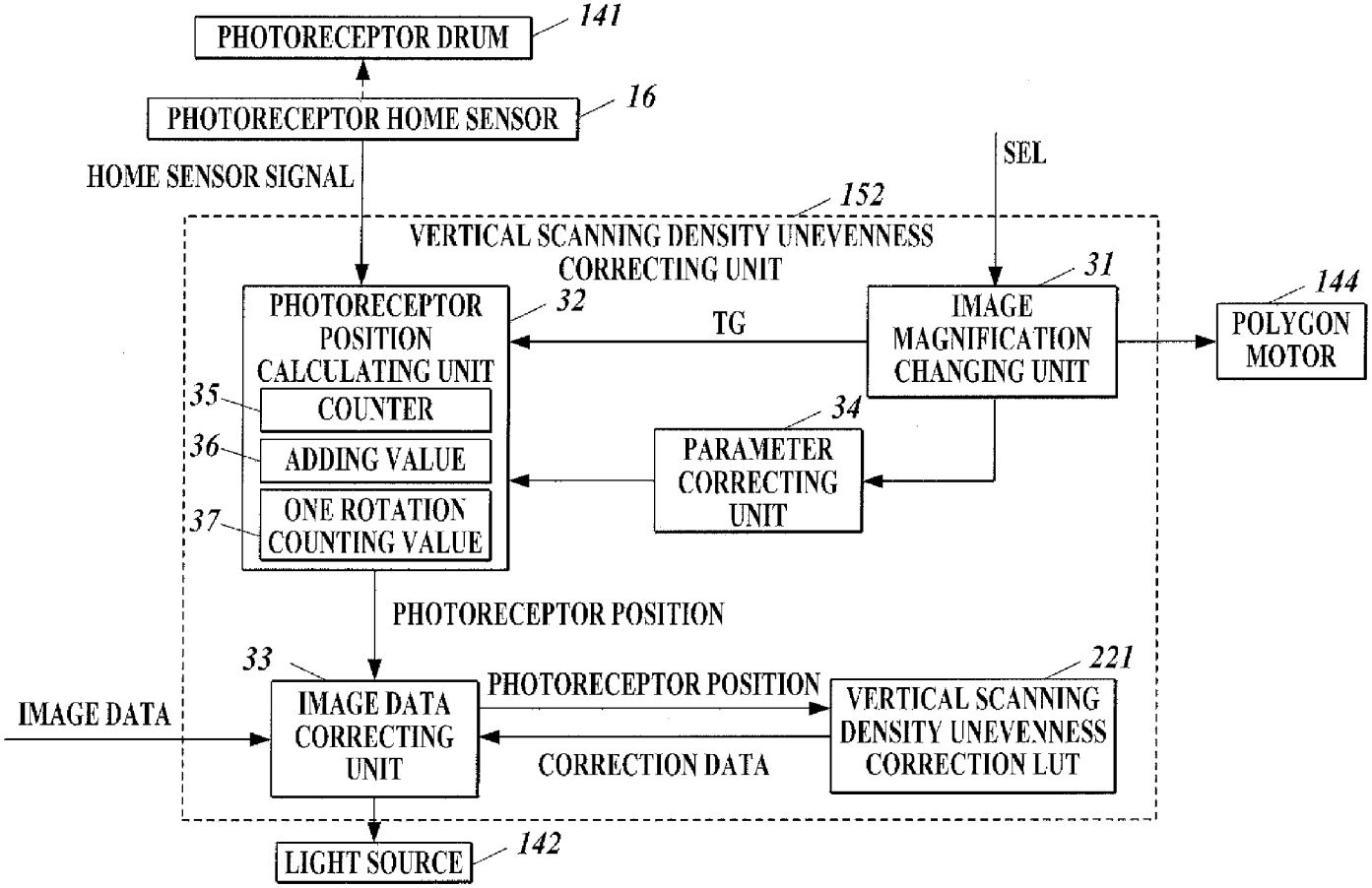
FIG. 3 is a functional block diagram of a vertical scanning density unevenness correcting unit.

FIG. 3 is a functional block diagram of the vertical scanning density unevenness correcting unit 152.

The vertical scanning density unevenness correcting unit 152 includes an image magnification changing unit 31, a photoreceptor position calculating unit 32, an image data correcting unit 33, and a parameter correcting unit 34.

The image magnification changing unit 31 changes the rotating speed of the polygon motor 144 to change the magnification of the image. The image magnification changing unit 31 changes the magnification of the image according to front face or back face of the sheet on which the image is formed. Specifically, the image magnification changing unit 31 increases the rotating speed of the polygon motor 114 so that the rotating speed is faster in the back face processing than the front face processing. With this, the magnification of the image becomes smaller in the back face processing than the front face processing.

Figure 4:
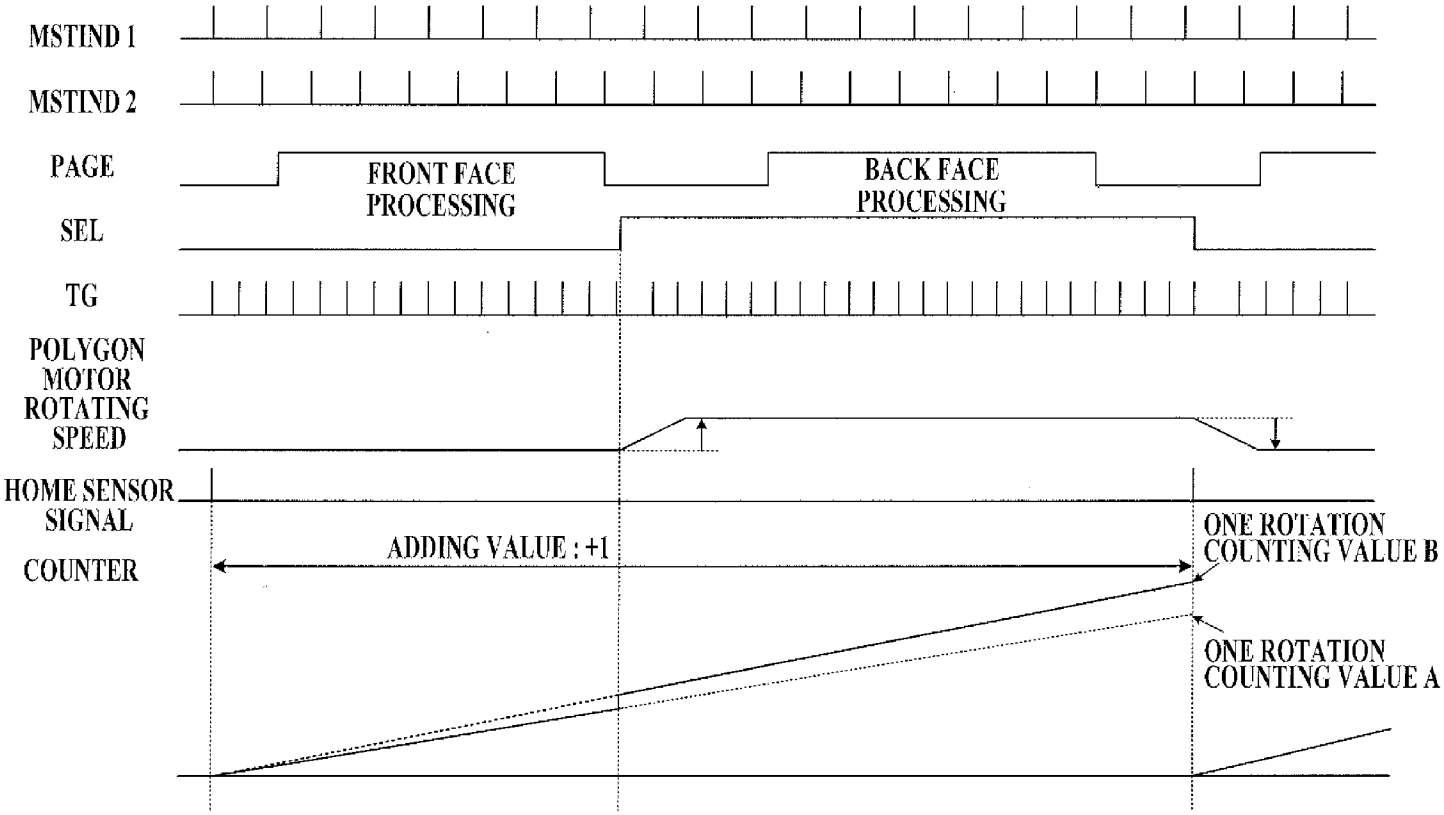
FIG. 4 is a timing chart according to the first embodiment.

The photoreceptor position calculating unit 32 calculates the position (phase) of the photoreceptor drum 141 in the vertical scanning direction based on the detecting result of the reference position of the photoreceptor drum 141 in the vertical scanning direction by the photoreceptor home sensor 16 and a signal showing the cycle of each line according to the rotating speed of the polygon motor 144 (line synchronizing signal TG shown in FIG. 4). Specifically, when the rotating speed of the polygon motor 144 becomes fast, the cycle of each line becomes short.

The cycle of the SOS signal corresponds to the time being exposed and scanned by one edge of the side face of the polygon motor 144 (when the polygon motor 144 is the hexagonal column, the time that the polygon motor 144 rotates ⅙ of the rotation). When the light source 142 emits n beams of laser light at the same time, the cycle of the SOS signal becomes n times the line cycle.

The photoreceptor position calculating unit 32 includes a counter 35 which is reset (0) when the reference position of the receptor drum 141 in the vertical scanning direction is detected by the photoreceptor home sensor 16, and adds a predetermined adding value 36 for each cycle of each line based on the line synchronizing signal TG. The photoreceptor position calculating unit 32 calculates the position of the photoreceptor drum 141 in the vertical scanning direction based on a ratio of a counting value of the counter 35 to a one rotation counting value 37 corresponding to one rotation of the photoreceptor drum 141. The address showing the position of the photoreceptor drum 141 in the vertical scanning direction can be obtained by the following formula.

address=256*present counting value of counter 35/one rotation counting value 37

The image data correcting unit 33 obtains the correction data corresponding to the position of the photoreceptor drum 141 in the vertical scanning direction from the vertical scanning density unevenness correction LOT 221 based on the position of the photoreceptor drum 144 in the vertical scanning direction calculated by the photoreceptor position calculating unit 32 and corrects the image data based on the obtained correction data.

The parameter correcting unit 34 corrects the parameter of the photoreceptor position calculating unit 32 according to the timing that the rotating speed of the polygon motor 144 is changed by the image magnification changing unit 31. Here, "according to the timing that the rotating speed of the polygon motor 144 is changed" is not limited to when the change of the rotating speed of the polygon motor 144 is detected. Image processing is performed before forming the image, therefore, the parameter of the photoreceptor position calculating unit 32 may be corrected before changing the rotating speed of the polygon motor 144. The parameter is information showing a numeric value used in calculating the position of the photoreceptor drum 141 in the vertical scanning direction in the photoreceptor position calculating unit 32.

FIG. 4 is a timing chart of the first embodiment.

FIG. 4 shows first master index signal MSTIND1, second master index signal MSTIND2, image valid region signal PAGE, select signal SEL, line synchronizing signal TG, polygon motor rotating speed, home sensor signal, and counter.

The first master index signal MSTIND1 is a signal showing a SOS cycle in the front face processing of the sheet.

The second master index signal MSTIND2 is a signal showing a SOS cycle in the back face processing of the sheet.

The image magnification changing unit 31 controls the rotating speed (rotating number) of the polygon motor 144 to match the SOS signal output from the SOS sensor 17 at the cycle of the first master index signal MSTIND1 or the second master index signal MSTIND2. For example, assuming that the sheet shrinks 1% in the vertical scanning direction after forming the image on the front face (100% to 99%), the rotating speed of the polygon motor 144 needs to be corrected 100/99 times with reference to the front face when forming the image on the back face. Therefore, the cycle of the second master index signal MSTIND2 becomes 1% shorter than that of the first master index signal MSTIND1.

The image valid region signal PAGE is a signal showing the image valid region in the vertical scanning direction.

The select signal SEL is the signal used for selecting the first master index signal MSTIND1 or the second master index signal MSTIND2.

The image magnification changing unit 31 selects the first master index signal MSTIND1 when the select signal SEL is 0, selects the second master index signal MSTIND2 when the select signal SEL is 1, and generates the line synchronizing signal TG.

The line synchronizing signal TG is a signal used in the image processing unit 15, and the image processing is performed in a cycle of each line synchronizing with the line synchronizing signal TG. When the print head is a 600 dpi/2beam structure, the image magnification changing unit 31 sets the cycle of the first master index signal MSTIND1 or the second master index signal MSTIND2 to ½, and generates the line synchronizing signal TG in a unit of 600 dpi.

If the line synchronizing signal TG is synchronized with the SOS signal (first master index signal MSTIND1 or second master index signal MSTIND2), the cycles do not have to be in a relation of 1:1. FIG. 4 shows an example when the cycles of the line synchronizing signal TG and the SOS signal are in a relation of 1:2.

The photoreceptor 141 operates independently from the sheet and is not synchronized with the conveying of the sheet. In other words, the reference position is not always detected by the photoreceptor home sensor 16 between one sheet and the next sheet, and the counter 35 of the photoreceptor position calculating unit 32 is not always reset. The calculating of the position of the photoreceptor drum 141 in the vertical scanning direction by the photoreceptor position calculating unit 32 needs to be performed continuously among sheets even when the image processing is not performed. Here, the reference position of the photoreceptor drum 141 in the vertical scanning direction is detected by the photoreceptor home sensor 16 before the front face processing and then the reference position of the photoreceptor drum 141 in the vertical scanning direction is detected by the photoreceptor home sensor 16 after the back face processing.

According to the first embodiment, the adding value 36 used in the photoreceptor calculating unit 32 is the same between before and after the correction by the parameter correcting unit 34. Here, 1 is used as the adding value 36.

The parameter correcting unit 34 corrects the counting value of the counter 35 and the one rotation counting value 37 in the photoreceptor position calculating unit 32 depending on the magnification according to the timing that the rotating speed of the polygon motor 144 is changed by the image magnification changing unit 31. Specifically, when the magnification before change is x and the magnification after change is y, the parameter correcting unit 34 multiplies the counting value of the counter 35 and the one rotation counting value 37 by x/y times.

The counter 35 operates based on the line synchronizing signal TG. When the reference position of the photoreceptor drum 141 in the vertical scanning direction is detected by the photoreceptor home sensor 16, the counter 35 is reset to 0. Then, the counter 35 adds 1 each time the line synchronizing signal TG doubling the frequency of the first master index signal MSTIND1 is input.

In an example where the sheet shrinks 1% in the vertical scanning direction after forming the image on the front face, the parameter correcting unit 34 corrects the counting value of the counter 35 by multiplying 100/99 times at the timing that the select signal SEL is changed to 1 when the front face processing ends and the processing advances to the back face processing. Then, the counter 35 adds 1 each time the line synchronizing signal TG doubling the frequency of the second master index signal MSTIND2 is input.

When the counter value is corrected, even after switching to the back face processing, it is as if the counter 35 counts with the line synchronizing signal TG doubling the frequency of the second master index signal MSTIND2 from the point when the reference position is detected by the photoreceptor home sensor 16 before the front face processing (when the counter 35 is reset).

The one rotation counting value 37 of the photoreceptor drum 141 is preset for the front face processing and the back face processing (one rotation counting value A, one rotation counting value B). The parameter correcting unit 34 corrects the one rotation counting value 37 of the photoreceptor position calculating unit 32 to the one rotation counting value A of the front face processing at the timing when the select signal SEL is changed to 0, and corrects the one rotation counting value 37 of the photoreceptor position calculating unit 32 to the one rotation counting value B of the back face processing at the timing when the select signal SEL is changed to 1. The one rotation counting value A of the front face processing and the one rotation counting value B of the back face processing are values according to the ratio of the magnification between the front face and the back face. The values are inversely proportional to the magnification and the cycle of the line synchronizing signal TG, and are in proportion to the rotating speed of the polygon motor 144. When the sheet shrinks 1% in the vertical scanning direction after the image is formed on the front face, the following is established, one rotation counting value A: one rotation counting value B=99:100.

The photoreceptor position calculating unit 32 outputs the address calculated using the following formula in the front face processing to the image data correcting unit 33.

address=256*present counting value of the counter 35/one rotation counting value *A*

Alternatively, the photoreceptor position calculating unit 32 outputs the address calculated using the following formula in the back face processing to the image data correcting unit 33.

address=256*present counting value of the counter 35/one rotation counting value *B*

As described above, according to the first embodiment, the position of the photoreceptor drum 141 can be correctly calculated when the density unevenness in the vertical scanning direction caused by the photoreceptor drum 141 is corrected even if the cycle of the signal (line synchronizing signal TG) for calculating the position of the photoreceptor drum 141 in the vertical scanning direction is changed.

Specifically, the position of the photoreceptor drum 141 in the vertical scanning direction can be calculated based on the ratio of the counting value in the counter 35 to the one rotation counting value 37 corresponding to one rotation of the photoreceptor drum 141.

Even if the photoreceptor drum 141 is not in the preset reference position, the position of the photoreceptor drum 141 can be correctly calculated. Therefore, the adjustment of the magnification among sheets can be done reducing the interval between sheets without waiting for the counter 35 to be reset.

The adding value 36 is the same between before and after the correction by the parameter correcting unit 34, and the parameter correcting unit 34 corrects the counting value of the counter 35 and the one rotation counting value 37 in the photoreceptor position calculating unit 32 depending on the magnification according to the timing that the rotating speed of the polygon motor 144 is changed by the image magnification changing unit 31. Therefore, the position of the photoreceptor drum 141 can be correctly calculated even after the rotating speed of the polygon motor 144 is changed.

In the first embodiment, an example using 1 as the adding value 36 is described. However, as long as the value is the same between before and after the correction by the parameter correcting unit 34, other values can be used as the adding value 36.

Second Embodiment

Next, the second embodiment applying the present invention is described.

The image forming apparatus of the second embodiment has a configuration similar to that of the image forming apparatus 10 shown in the first embodiment. Therefore, FIG. 1 to FIG. 3 are to be referred and the illustration and description of the configuration is omitted. Below, the configuration and the processing characteristic to the second embodiment are described.

Figure 5:
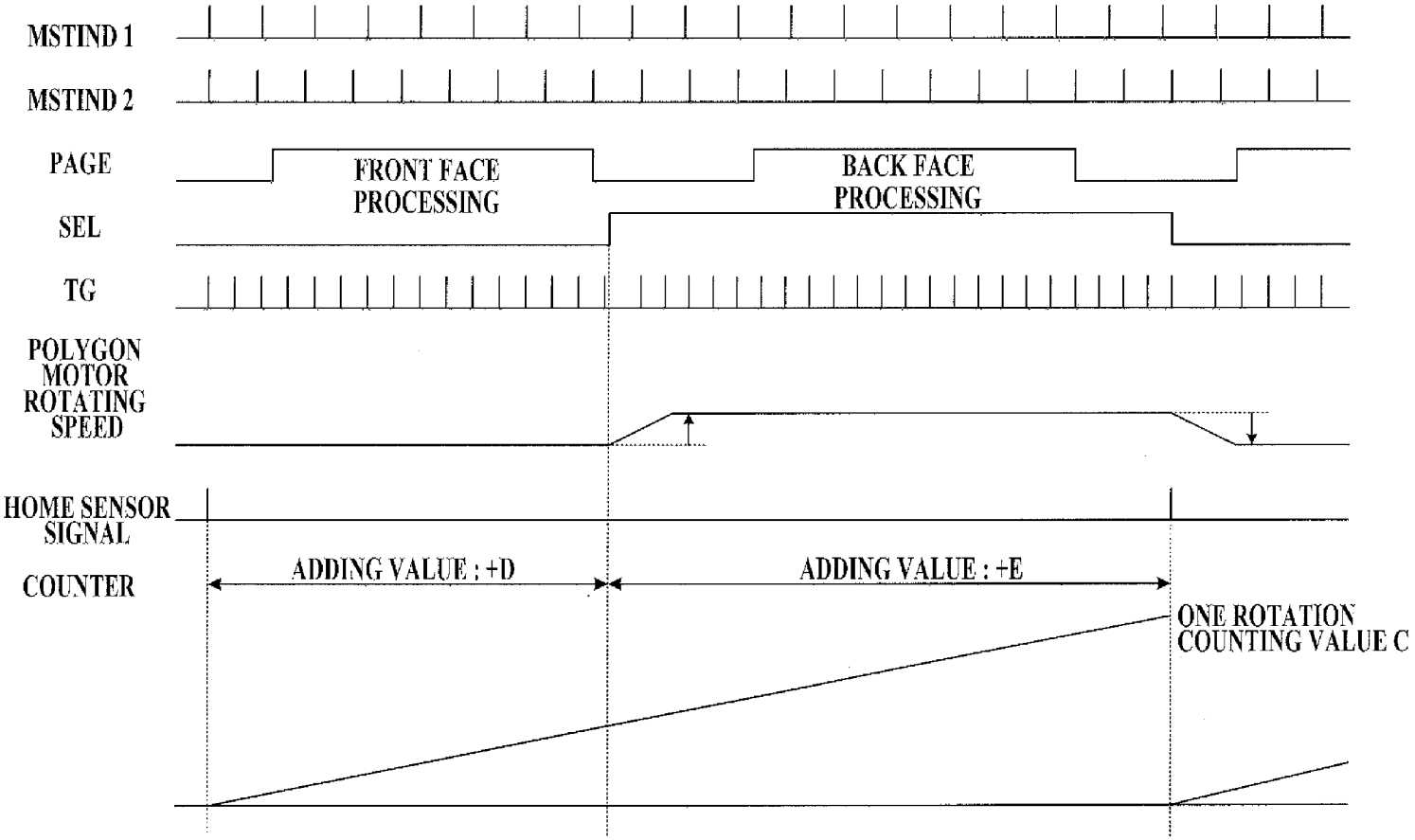
FIG. 5 is a timing chart according to the second embodiment.

FIG. 5 is a timing chart of the second embodiment.

FIG. 5 shows first master index signal MSTIND1, second master index signal MSTIND2, image valid region signal PAGE, select signal SEL, line synchronizing signal TG, polygon motor rotating speed, home sensor signal, and counter.

The first master index signal MSTIND1, the second master index signal MSTIND2, the image valid region signal PAGE, the select signal SEL, the line synchronizing signal TG, the polygon motor rotating speed, and the home sensor signal are the same as those of the first embodiment.

In the second embodiment, the one rotation counting value 37 used in the photoreceptor position calculating unit 32 is the same between before and after the correction by the parameter correcting unit 34 (one rotation counting value C).

The parameter correcting unit 34 corrects the adding value 36 in the photoreceptor position calculating unit 32 depending on the magnification according to the timing that the rotating speed of the polygon motor 144 is changed by the image magnification changing unit 31. Specifically, when the magnification before change is x and the magnification after change is y, the parameter correcting unit 34 multiplies the adding value 36 by y/x times.

The counter 35 operates based on the line synchronizing signal TG. When the reference position of the photoreceptor drum 141 in the vertical scanning direction is detected by the photoreceptor home sensor 16, the counter 35 is reset to 0. Then, the counter 35 adds the predetermined adding value D each time the line synchronizing signal TG doubling the frequency of the first master index signal MSTIND1 is input.

When the sheet shrinks 1% in the vertical scanning direction after forming the image on the front face, the parameter correcting unit 34 corrects the value to a value multiplying the adding value 36 of the counter 35 by 99/100 times (adding value E) at the timing when the select signal SEL is changed to 1 when the front face processing ends and the processing advances to the back face processing. Then, the counter 35 adds the adding value E each time the line synchronizing signal TG doubling the frequency of the second master index signal MSTIND2 is input.

The adding value D and the adding value E are values according to the ratio of the magnification between the front face and the back face. The values are in proportion to the magnification and the cycle of the line synchronizing signal TG, and are inversely proportional to the rotating speed of the polygon motor 144. When the sheet shrinks 1% in the vertical scanning direction after the image is formed on the front face, the following is established, adding value D: adding value E=100:99.

The adding value 36 is adjusted according to the ratio of the magnification, and therefore, the counting value after one rotation of the photoreceptor drum 141 (one rotation counting value 37) does not change.

As described above, according to the second embodiment, the position of the photoreceptor drum 141 can be correctly calculated when the density unevenness in the vertical scanning caused by the photoreceptor drum 141 direction is corrected even if the cycle of the signal (line synchronizing signal TG) for calculating the position of the photoreceptor drum 141 in the vertical scanning direction is changed.

Specifically, the position of the photoreceptor drum 141 in the vertical scanning direction can be calculated based on the ratio of the counting value in the counter 35 to the one rotation counting value 37 corresponding to one rotation of the photoreceptor drum 141.

Even if the photoreceptor drum 141 is not in the preset reference position, the position of the photoreceptor drum 141 can be correctly calculated. Therefore, the adjustment of the magnification among sheets can be done reducing the interval between sheets without waiting for the counter 35 to be reset.

The one rotation counting value 37 is the same between before and after the correction by the parameter correcting unit 34, and the parameter correcting unit 34 corrects the adding value 36 in the photoreceptor position calculating unit 32 depending on the magnification according to the timing that the rotating speed of the polygon motor 144 is changed by the image magnification changing unit 31. Therefore, the position of the photoreceptor drum 141 can be correctly calculated even after the rotating speed of the polygon motor is changed.

The description of the above described embodiments are examples of the image forming apparatus of the present invention, and the present invention is not limited to the above. The detailed configuration of each unit and the detailed operation composing the apparatus can be suitably modified without leaving the scope of the present invention.

For example, in the above described embodiments, the photoreceptor drum 141 is described as an example of the target component which causes the density unevenness in the vertical scanning direction. However, the target component can be a developer, an intermediate transfer belt or the like.

In the above described embodiments, the signal showing the cycle of each line (line synchronizing signal TG) is used as the signal with the predetermined cycle according to the rotating speed of the polygon motor 144, and the counter 35 counts up in a unit of the cycle of each line. However, a signal other than the line synchronizing signal TG can be used if the signal is a cycle corresponding to the rotating speed of the polygon motor 144. However, preferably a signal with the same cycle as the line synchronizing signal TG or a signal with a shorter cycle is used in order to accurately calculate the position of the photoreceptor drum 141 in the vertical scanning direction.

According to the above description, a ROM is used as the computer readable medium storing the program to execute each processing, however, the present invention is not limited to the above. A nonvolatile memory such as a flash memory or a portable recording medium such as a CD-ROM can be used as the computer readable medium. Moreover, as the medium providing the data of the program through communication lines, a carrier wave can be applied.

The present U.S. patent application claims priority under the Paris Convention of Japanese Patent Application No. 2014-027279 filed on Feb. 17, 2014 the entirety of which is incorporated herein by reference.

What is claimed is:

1. An image forming apparatus comprising:

an image forming unit that scans a laser light based on image data with a polygon mirror to expose light to a photoreceptor drum to form an electrostatic latent image on the photoreceptor drum and forms an image by attaching toner to the electrostatic latent image;

an image magnification changing unit that changes a rotating speed of a polygon motor for rotating the polygon mirror to change magnification of the image;

a reference position detecting unit which detects a reference position of a predetermined target component in a vertical scanning direction, the predetermined target component causing density unevenness in the vertical scanning direction;

a target component position calculating unit which calculates a position of the target component in the vertical scanning direction based on a detecting result of the reference position of the target component in the vertical scanning direction by the reference position detecting unit and a signal of a predetermined cycle according to the rotating speed of the polygon motor;

a storage unit which stores a correction table in which a position of the target component in the vertical scanning direction is corresponded to correction data to correct density unevenness caused by the target component;

an image data correcting unit which obtains the correction data corresponded to the position of the target component in the vertical scanning direction from the correction table based on the position of the target component in the vertical scanning direction calculated by the target component position calculating unit and corrects the image data based on the obtained correction data; and a parameter correcting unit which corrects a parameter in the target component position calculating unit according to a timing that the rotating speed of the polygon motor is changed by the image magnification changing unit, wherein the target component position calculating unit includes a counter which is reset when the reference position of the target component in the vertical scanning direction is detected by the reference position detecting unit and adds a predetermined adding value each time based on the signal; and the target component position calculating unit calculates the position of the target component in the vertical scanning direction based on a ratio of a counting value of the counter to a one rotation counting value corresponding to one rotation of the target component.

2. The image forming apparatus of claim 1, wherein, the signal is a signal showing a cycle of each line; and the counter adds the adding value at each cycle of each line.

3. The image forming apparatus of claim 1, wherein, the adding value is a same value between before and after correction by the parameter correcting unit; and the parameter correcting unit corrects the counting value of the counter and the one rotation counting value in the target component position calculating unit depending on the magnification according to the timing that the rotating speed of the polygon motor is changed by the image magnification changing unit.

4. The image forming apparatus of claim 1, wherein, the one rotation counting value is a same value between before and after correction by the parameter correcting unit; and the parameter correcting unit corrects the adding value in the target component position calculating unit depending on the magnification according to the timing that the rotating speed of the polygon motor is changed by the image magnification changing unit.

5. The image forming apparatus of claim 1, wherein, the image magnification changing unit changes the magnification of the image according to whether the image is formed on a front face or a back face of a sheet.

* * * * *